United States Patent [19]

Greene et al.

[11] 4,172,167

[45] Oct. 23, 1979

[54] ONE PIECE PERIPHERALLY RIBBED SHEET METAL DOOR

[76] Inventors: Carl B. Greene; Carl B. Greene, III, both of P.O. Box 948, Chickasha, Okla. 73018

[21] Appl. No.: 867,188

[22] Filed: Jan. 4, 1978

[51] Int. Cl.[2] ..... B32B 3/04

[52] U.S. Cl. ..... 428/120; 40/124.1; 113/116 HA; 428/122; 428/124; 428/595

[58] Field of Search ..... 428/120, 121, 124, 126, 428/127, 128, 595, 122; 156/227; 113/1 N, 116 F, 116 HA, 116 V; 52/631-658; 40/124.1, 152.1, 155

[56] References Cited

U.S. PATENT DOCUMENTS

| | | | |
|---|---|---|---|
| 1,768,742 | 7/1930 | Brogden | 113/116 F |
| 2,149,882 | 3/1939 | Clements | 113/116 F |
| 2,241,266 | 5/1941 | Mayne et al. | 113/116 HA |
| 2,756,463 | 7/1956 | Clements | 52/631 X |
| 3,792,522 | 2/1974 | Gray et al. | 113/116 HA X |
| 3,848,324 | 11/1974 | Perger | 113/116 F X |

FOREIGN PATENT DOCUMENTS

| | | | |
|---|---|---|---|
| 1159880 | 2/1958 | France | 113/116 F |

*Primary Examiner*—Henry F. Epstein
*Attorney, Agent, or Firm*—Clarence A. O'Brien; Harvey B. Jacobson

[57] ABSTRACT

A single generally rectangular panel member is provided including first and second pairs of opposite sides. The panel member defines first peripherally extending generally straight first outer marginal fold zones outwardly beyond and along which corresponding outer marginal portions of the panel member project and extend. The marginal portions are each reversely bent along the first fold zones over the first side of the panel member and each of the marginal portions, spaced outwardly of the corresponding first fold zone, includes successive second and third fold zones, between which corresponding second outer marginal areas of the marginal portions are defined, along which the marginal portions are bent, at generally right angles, toward the second and first sides of the panel member, respectively, first outer areas of the outer marginal portions being defined between corresponding first and second fold zones of the panel member. The marginal portions each further include a fourth fold zone, outwardly of the corresponding third fold zone, along which the marginal portion is folded, at generally right angles, toward the first side of the panel member, the marginal portions between corresponding third and fourth zones, each defining a third outer marginal area and the adjacent ends of adjacent third outer marginal areas are disposed in overlapped engagement with each other.

7 Claims, 5 Drawing Figures

ONE PIECE PERIPHERALLY RIBBED SHEET METAL DOOR

BACKGROUND OF THE INVENTION

Various forms of sheet metal panels and doors have been heretofore provided with peripheral, crossed and diagonal bracing. However, most sheet metal doors or panels provided with such bracing are either constructed of multiple sheet metal sections or include only minimal bracing. Accordingly, a need exists for a one-piece sheet metal door or panel including ample peripheral bracing.

Examples of various forms of single and multiple sheet metal section panels and doors including peripheral and crossed bracing are disclosed in U.S. Pat. Nos. 1,768,742, 2,149,882, 2,241,266, 3,792,522 and 3,848,324.

BRIEF DESCRIPTION OF THE INVENTION

The sheet metal door of the instant invention is constructed from a single piece of sheet metal and includes ample rib-type peripheral reinforcing. The sheet metal door is disclosed as being generally rectangular in configuration, but may be readily constructed to include more than four sides. In addition, the sheet metal door may be constructed of substantially any size slightly less than the dimensions of the sheet metal panel of which it is constructed. Further, one side of the sheet metal door is completely uninterrupted.

The main object of this invention is to provide a one-piece sheet metal door incorporating ample peripheral rib-type bracing.

Another object of this invention is to provide a sheet metal door which may be constructed so as to include four or more side marginal edges and which may also be triangular in plan shape.

Another important object of this invention is to provide a one-piece peripherally ribbed sheet metal door which may be constructed from a sheet metal panel only slightly greater in dimensions than the plan dimensions of the finished door.

Yet another important object of this invention is to provide a one-piece sheet metal door including one side thereof which is totally uninterrupted.

A final object of this invention to be specifically enumerated herein is to provide a one-piece sheet metal door in accordance with the preceding objects and which will conform to conventional forms of manufacture and be of simple construction so as to provide a device that will be economically feasible.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
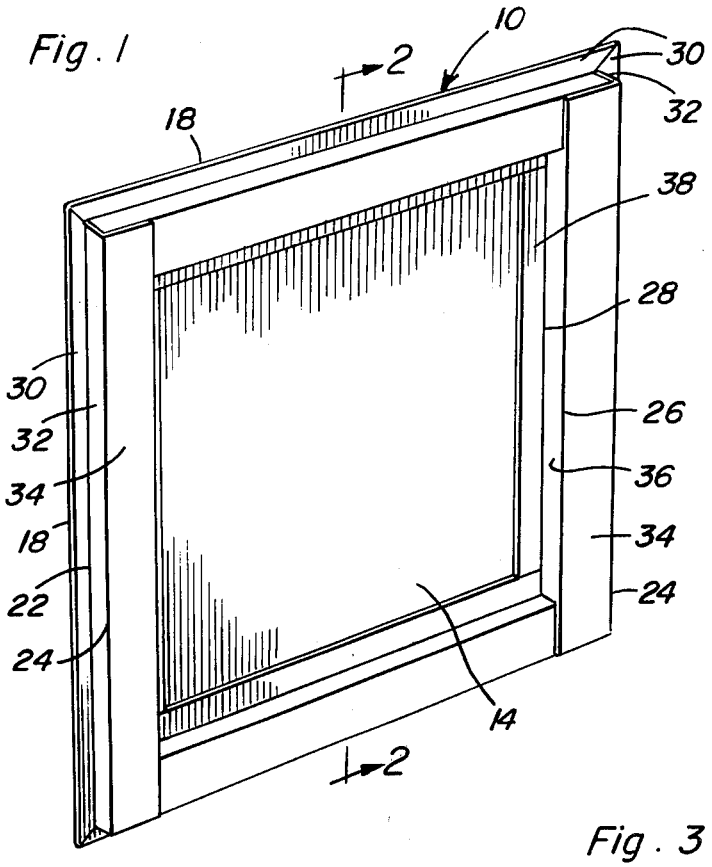
FIG. 1 is a perspective view of the inner side of the sheet metal door of the instant invention.
Figure 2:
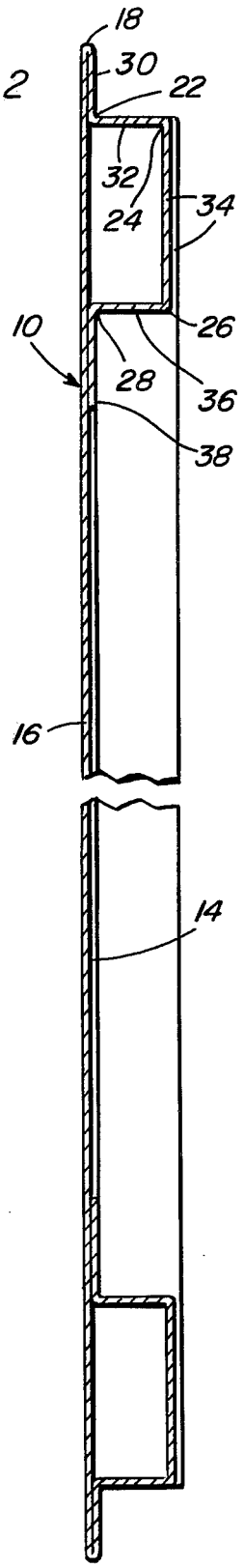
FIG. 2 is an enlarged, fragmentary, vertical sectional view taken substantially upon the plane indicated by the section line 2—2 of FIG. 1.
Figure 3:
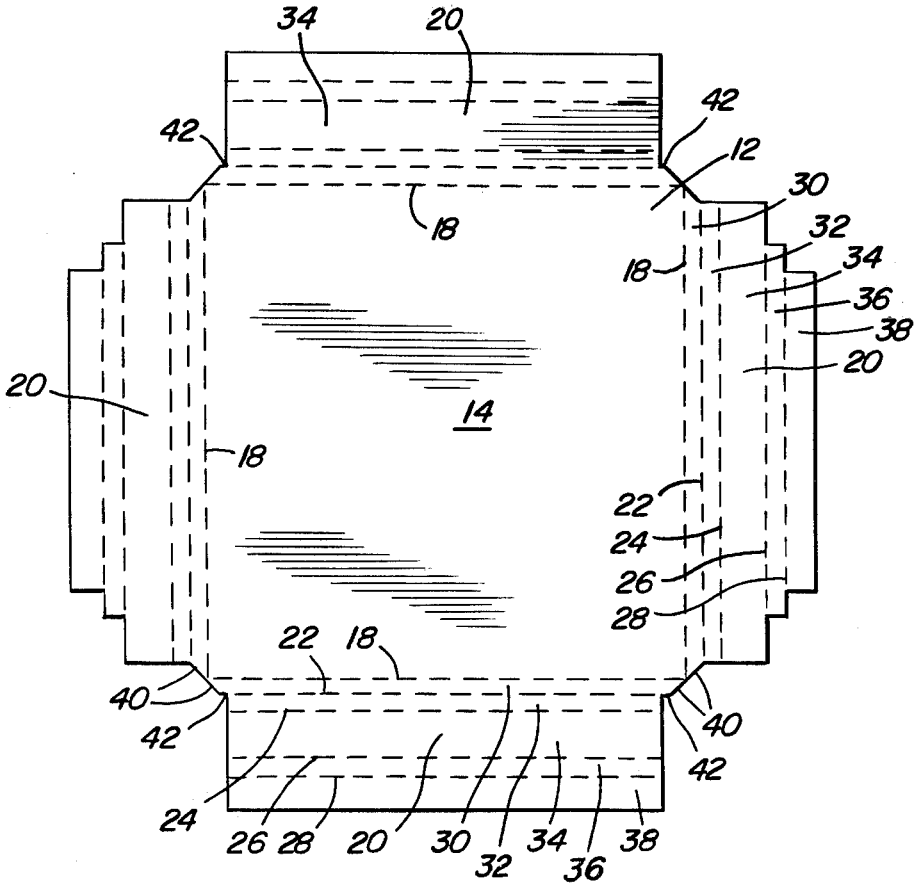
FIG. 3 is a plan view of a sheet metal blank from which the door may be formed.
Figure 4:
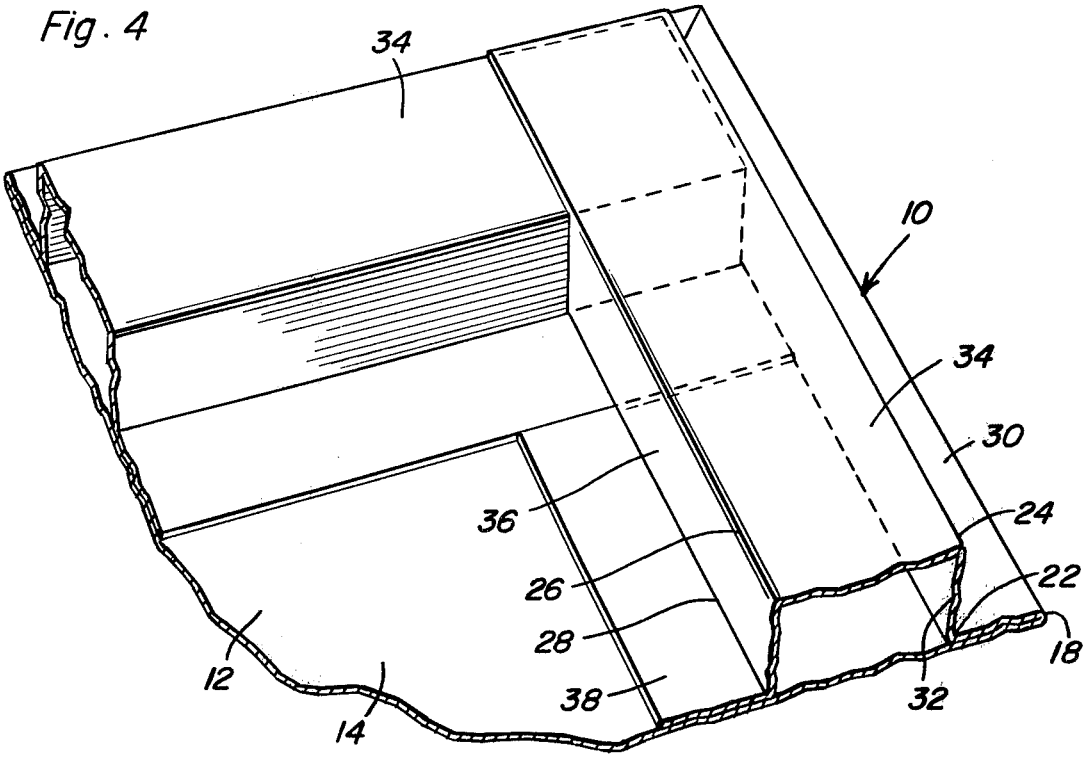
FIG. 4 is a fragmentary, enlarged, perspective view of the inner side of one of the corner portions of the door with remainder of the door being broken away.

Referring now more specifically to the drawings, the numeral 10 generally designates a first form of peripherally ribbed sheet metal door constructed in accordance with the present invention. The door 10 comprises a single panel member 12 constructed of sheet metal and the panel member 12 includes first and second inner and outer sides 14 and 16. The panel member 12 defines first peripherally extending generally straight first outer marginal fold zones 18 outwardly beyond and along which corresponding outer marginal portions 20 of the panel member 12 project and extend. Further, the panel member 12 includes second, third, fourth and fifth outer fold zones 22, 24, 26 and 28, respectively, paralleling each of the first fold zones 18. Each marginal portion 20 defines first, second, third, fourth and fifth outer marginal areas 30, 32, 34, 36 and 38 disposed between the zones 18 and 22, 22 and 24, 24 and 26, 26 and 28 and outwardly of the zones 28, respectively. The adjacent ends of adjacent areas 30 are coextensively beveled as at 40 and the areas 36 and 38 of one pair of remote marginal portions 20 are shorter than the corresponding areas 34 and 36 while the areas 32, 34, 36 and 38 of the other pair of remote marginal portions 20 are of the same length, but spaced slightly inwardly of the shorter longitudinal sides of the corresponding areas 30 as at 42.

When it is desired to form the door 10 from the panel member 12, the marginal portions 20 are reversely bent along the fold zones 18 over the first inner side 14 of the panel member 12. Thereafter, the marginal portions 20 are bent at substantially 90 degrees toward the outer side 16 of the panel member 12 along the fold zones 22 and are thereafter bent, at generally right angles, along the fold zones 24 toward the inner side 14 of the panel member 12. Thereafter, the marginal portions 20 are bent along the fold zones 26, at generally right angles, toward the inner side 14 of the panel member 12 and finally bent along the fold zones 28 toward the outer side 16 of the panel member 12.

When the panel member 12 has thus been folded, the beveled edges 40 of adjacent ends of areas 30 are disposed in edge abutting relation, the ends of adjacent areas 32 are disposed in edge-to-side face abutting engagement, the ends of adjacent areas 34 are disposed in overlapped engagement in surface-to-surface contact with each other, the ends of adjacent zones 36 are disposed in edge-to-outer side abutting engagement with each other and the ends of adjacent areas 38 are disposed in end edge to longitudinal edge abutting engagement with each other. Of course, after the door 10 has been formed the areas 38 are disposed in outer side to inner side abutting engagement with the opposing surfaces of the panel member 12 and may be secured directly thereto, if desired. Further, the overlapped adjacent ends of the areas 34 may also be directly secured to each other.

In this manner, an extremely rigid sheet metal panel or door is formed having continuous peripheral reinforcing and the outer side of the door 10 is uninterrupted. Further, although not required, the various edge-to-side surface abutting portions of the adjacent area ends 34 and 36 may be secured together by welding and the end edge to longitudinal edge abutting portions of the areas 38 may be secured together by welding.

Figure 5:
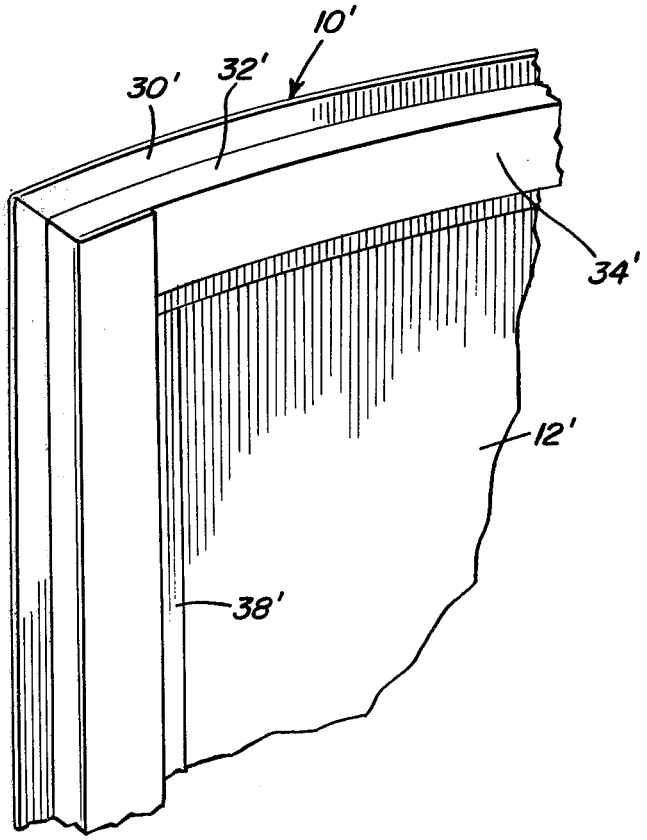
FIG. 5 is a fragmentary, perspective view of a second door constructed in accordance with the present invention, but which has been formed to be arcuate in configuration.

With attention now invited more specifically to FIG. 5 of the drawings, there will be seen a modified form of door referred to in general by the reference numeral 10' and which is substantially identical to the door 10, except that the entire door structure is arcuate. Of course, in forming the door 10' more sophisticated bending equipment must be used in order to form the areas 30', 32', 34', 36' and 38' of one pair of opposite marginal portions 20' of the panel member 12' corresponding to the panel member 12 with the appropriate radii of curvature.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A one-piece peripherally reinforced panel, said panel including a panel member including first and second opposite sides and defining first peripherally extending generally straight first outer marginal fold zones outwardly beyond and along which corresponding outer marginal portions of said panel member project and extend, said marginal portions each being reversely bent along said first fold zones over the first side of said panel member, each of said marginal portions, spaced outwardly of the corresponding first fold zone, including successive second and third fold zones, between which corresponding second outer marginal areas of said marginal portions are defined, along which said marginal portions are bent, at generally right angles, toward said second and said first sides, respectively, of said panel member, first outer marginal areas of said outer marginal portions being defined between corresponding first and second fold zones, said marginal portions each including a fourth fold zone, outwardly of the corresponding third fold zone, along which the corresponding marginal portion is folded, at generally right angles, toward the first side of said panel member, said marginal portions, between corresponding third and fourth fold zones, each defining a third outer marginal area, the adjacent ends of adjacent third outer marginal areas being disposed in overlapped engagement with each other, and anchoring means anchoring the marginal portions of said third marginal areas remote from said second marginal areas relative to said panel inwardly of the corresponding second outer marginal fold zones.

2. The combination of claim 1 wherein said marginal portions each include a fifth fold zone, outwardly of the corresponding fourth fold zone, along which the corresponding marginal portion is folded, at generally right angles, toward the second side of said panel member, said marginal portions, between corresponding fourth and fifth fold zones, each defining a fourth outer marginal area.

3. The combination of claim 2 wherein the ends of adjacent fourth outer marginal areas are disposed in edge-to-panel member side abutting relation.

4. The combination of claim 2 wherein said marginal portions, outwardly of said fifth fold zones include fifth outer marginal areas abutted against said first side of said panel member.

5. The combination of claim 4 wherein said fifth outer marginal areas are secured to said first side of said panel member, said fourth and fifth outer marginal areas comprising said anchoring means.

6. The combination of claim 5 wherein the ends of adjacent fourth marginal areas are disposed in edge-to-panel member side abutting relation.

7. The combination of claim 6 wherein the adjacent ends of adjacent fifth outer marginal areas are disposed in end edge-to-longitudinal edge abutting relation.

* * * * *